US009127491B2

(12) United States Patent
Bouthillier

(10) Patent No.: US 9,127,491 B2
(45) Date of Patent: Sep. 8, 2015

(54) DOOR SUPPORT FOR GLASS SLIDING DOOR AND ASSEMBLY

(75) Inventor: Serge Bouthillier, Ste-Marthe-sur-le-Lac (CA)

(73) Assignee: GROUPE VFG INC., Bois-des-Filion ( * ) Notice: Subject to any disclaimer, the term of this patent is extended or adjusted under 35 U.S.C. 154(b) by 0 days.

(21) Appl. No.: 13/481,257

(22) Filed: May 25, 2012

(65) Prior Publication Data

US 2012/0297686 A1 Nov. 29, 2012

Related U.S. Application Data

(60) Provisional application No. 61/489,888, filed on May 25, 2011.

(51) Int. Cl.

| | |
|---|---|
| ***E05D 15/06*** | (2006.01) |
| ***E05D 5/02*** | (2006.01) |
| ***E06B 3/46*** | (2006.01) |

(52) U.S. Cl.

CPC ..... *E05D 15/063* (2013.01); *E05D 5/0246* (2013.01); *E06B 3/4681* (2013.01); *E05Y 2800/672* (2013.01); *E05Y 2900/132* (2013.01); *Y10T 16/364* (2015.01)

(58) Field of Classification Search

CPC ..... E05D 15/063; E05D 15/0652; E06B 3/42; E06B 3/46; E06B 3/4636; E06B 3/4681; E06B 1/56; E06B 1/60; E06B 1/6023; E06B 1/6046; E06B 1/6064; E06B 1/6076; Y10T 16/376; Y10T 16/379

USPC ..... 49/409, 410, 411, 116, 118, 120, 366, 49/370, 425

See application file for complete search history.

(56) References Cited

U.S. PATENT DOCUMENTS

| | | | | | |
|---|---|---|---|---|---|
| 246,286 | A * | 8/1881 | Brinton | 16/106 |
| 856,607 | A * | 6/1907 | Schuyler et al. | 16/94 R |
| 1,225,098 | A * | 5/1917 | Addison | 16/87 R |
| 2,485,296 | A * | 10/1949 | Lescaze | 49/368 |
| 3,468,509 | A * | 9/1969 | Foltz | 248/316.6 |
| 4,034,439 | A * | 7/1977 | Kohne | 16/96 R |
| 5,351,442 | A * | 10/1994 | Gingras | 49/411 |
| 6,098,342 | A * | 8/2000 | Bischof et al. | 49/409 |
| 7,568,311 | B2 * | 8/2009 | Shivak et al. | 49/409 |
| 7,735,262 | B2 * | 6/2010 | Peterson | 49/372 |
| 8,375,638 | B2 * | 2/2013 | Martin et al. | 49/409 |
| 8,474,097 | B2 * | 7/2013 | Andren et al. | 16/98 |

* cited by examiner

*Primary Examiner* — Katherine Mitchell
*Assistant Examiner* — Catherine A Kelly
(74) *Attorney, Agent, or Firm* — Norton Rose Fulbright Canada LLP

(57) ABSTRACT

A sliding door assembly comprising one or more glass doors. Roller units are secured to a top portion of each the glass doors. The roller unit have a roller portion projecting out of a plane of the glass door. End members adapted to be secured to a structure at opposite ends of two transoms. Each said end member has two receptacles for receiving opposed ends of the end members. The receptacles of each said end member being spaced apart to hold the at least two transoms in a spaced apart and generally parallel relation, such that a guideway is defined between the transoms for holding captive the roller portion of the at least one roller unit for movement of the at least one glass door in its plane.

17 Claims, 13 Drawing Sheets

DOOR SUPPORT FOR GLASS SLIDING DOOR AND ASSEMBLY

CROSS-REFERENCE TO RELATED APPLICATION(S)

The present application claims priority on U.S. Provisional Patent Application No. 61/489,888, filed on May 25, 2011, and incorporated herein by reference.

FIELD OF THE APPLICATION

The present disclosure generally relates to glass doors and more specifically to glass sliding door assemblies and the various components thereof.

BACKGROUND OF THE ART

The use of glass as a structural paneling component is increasingly popular. Treated glass has a suitable structural integrity, in addition to all other qualities it possesses. Accordingly, domestic and commercial design now features various components in glass, such as doors, walls, curtain walls and the like. However, such structural components are relatively heavy as treated glass is relatively thick, whereby some support systems must be devised to support them. As the beauty of glass rests in its transparency or translucence, support systems for structural glass must be as discreet as possible.

SUMMARY OF THE APPLICATION

It is therefore an aim of the present disclosure to provide a novel door support for glass sliding door assembly.

Therefore, in accordance with the present application, there is provided a sliding door assembly comprising: at least one glass door; at least one roller unit secured to a top portion of each the at least one glass door, the roller unit having a roller portion projecting out of a plane of the glass door; at least two transoms; and end members adapted to be secured to a structure at opposite ends of the at least two transoms, each said end member having at least two receptacles for receiving opposed ends of the end members, the at least two receptacles of each said end member being spaced apart to hold the at least two transoms in a spaced apart and generally parallel relation, such that a guideway is defined between the transoms for holding captive the roller portion of the at least one roller unit for movement of the at least one glass door in its plane.

Further in accordance with the present disclosure, there is provided a door support kit for a sliding door assembly comprising: at least two transoms; and end members adapted to be secured to a structure at opposite ends of the at least two transoms, each said end member having at least two receptacles for receiving opposed ends of the end members, the at least two receptacles of each said end member being spaced apart to hold the at least two transoms in a spaced apart and generally parallel relation, such that a guideway is defined between the transoms for holding captive roller portion of at least one roller unit for movement of a glass door in its plane.

BRIEF DESCRIPTION OF THE DRAWINGS

FIG. 8 is an assembly view of the end member of FIG. 2C with a pair of transoms;

DESCRIPTION OF THE PREFERRED EMBODIMENTS

Figure 1:
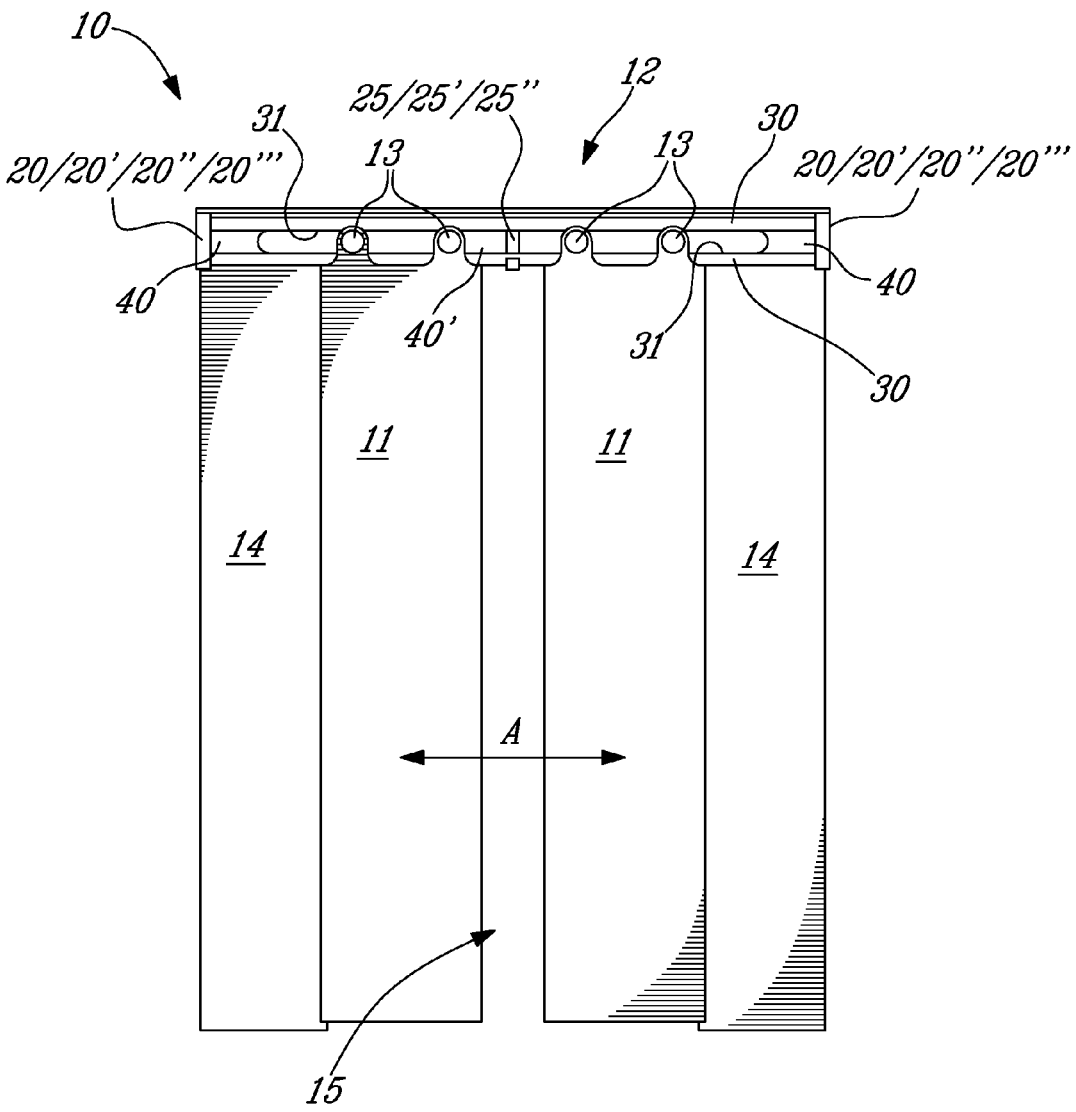
FIG. 1 is an elevation view of a glass sliding door assembly of the present disclosure.

Referring to the drawings and more particularly to FIG. 1, there is illustrated a glass sliding door assembly at 10. The glass sliding door assembly 10 may feature a pair of glass sliding doors 11, as shown in the embodiment of FIG. 1. It is pointed out that the glass sliding door assembly 10 may feature a single one or more than two of the glass sliding door 11.

The glass sliding doors 11 are supported by a door support 12, that is secured to a structure (e.g., walls, ceilings, etc) of a building. According to some embodiments, the door support 12 is secured to a structural glass wall, as illustrated hereinafter.

Figure 10:
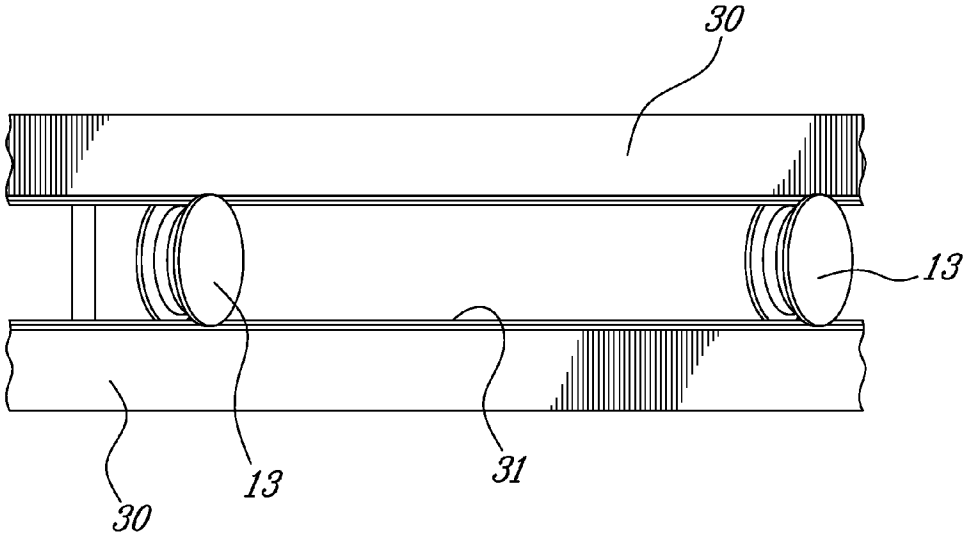
FIG. 10 is a perspective view of a glass sliding door with roller units in accordance with the present disclosuire.

As shown concurrently in FIGS. 1 and 10, roller units 13 are positioned at a top of the glass sliding doors 11 and interface the glass sliding doors 11 to the door support such that the glass sliding doors 11 may translate along direction A. The glass doors 11 are referred to as sliding doors as this is common terminology for doors that translate in their plane, despite the fact that roller units 13 are used in the illustrated embodiment, and thus there is little or negligible sliding movement.

The roller units 13 are for instance of the type described in Canadian Patent No. 2,668,218 by the present Assignee (U.S. Patent Application Publication No. 20100307063), and incorporated herewith by reference. Accordingly, a connector end of each of the roller units 13 is secured to the sliding doors 11, with the rolling portion being out of the plane of the sliding door 11, to be received in the door support 12, as will be described hereinafter. The roller units 13 may therefore have a pulley shape with a V-type groove, square groove, etc. However, any other type of roller unit, with or without rolling elements, may be used.

Moreover, any device allowing the translation of the sliding doors 11 relative to the door support 12 may be used as well.

Fixed panels 14 may be provided in the assembly 10 and are secured adjacent to the glass sliding doors 11 to close off the sides of an opening. Such fixed panels 14 may be referred to as sidelights. The glass sliding doors 11 move towards and away from one another in directions A to allow entrance through opening 15. The fixed panels 14 may be made of any appropriate material, but are typically made of glass or like transparent or translucent material.

Figure 2C:
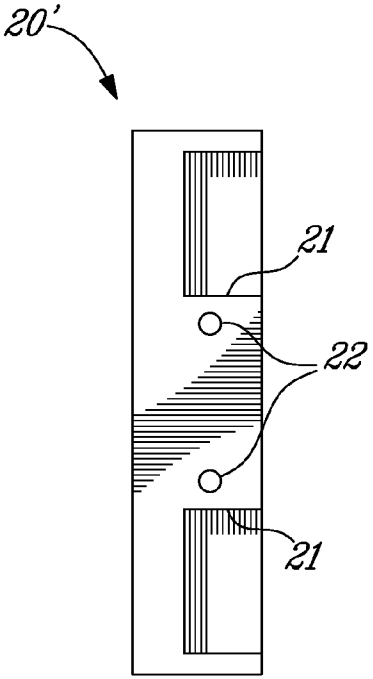
FIG. 2C is a perspective view of an end member of a door support of the glass sliding door assembly of FIG. 1, in accordance with another embodiment.
Figure 2B:
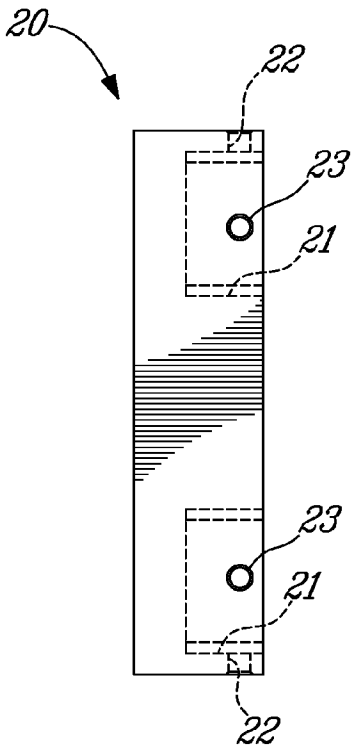
FIG. 2B is a side view of the end member of FIG. 2A.
Figure 2A:
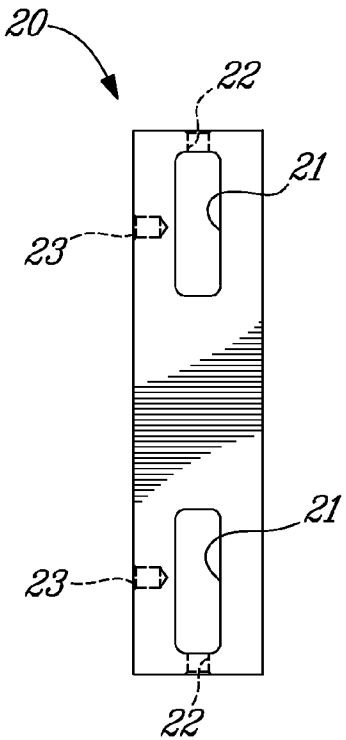
FIG. 2A is a front view of an end member of a door support of the glass sliding door assembly of FIG. 1.

Referring to FIG. 2A, there is illustrated at 20 one of the end members used as part of the door support 12 to support the sliding doors 11 to a structure. The end members 20 are positioned at opposed ends of the door support 12.

Each of the end members 20 has a body defining a pair of receptacles 21. The body must be of sufficient strength to support the weight of the glass sliding doors 11. For instance, the end members 20 are generally made of a solid body of a metallic component. The receptacles 21 have a rectangular section and project into the body of the end member 20 from the front face. Tapped bores 22 are provided and are in communication with the receptacles 21. The tapped bores 22 are each used to receive a set screw (not shown) or the like that will be used to fix transoms into the receptacles 21. The end members 20 may be secured to a structure by any appropriate way, for instance via bores 23. The bores 23 are used when the end member 20 is to be secured to a wall or structure that is parallel to the side face of the end member 20. The bores 23 may be accessed via the receptacles 21, prior to installation of transoms.

Figure 8:
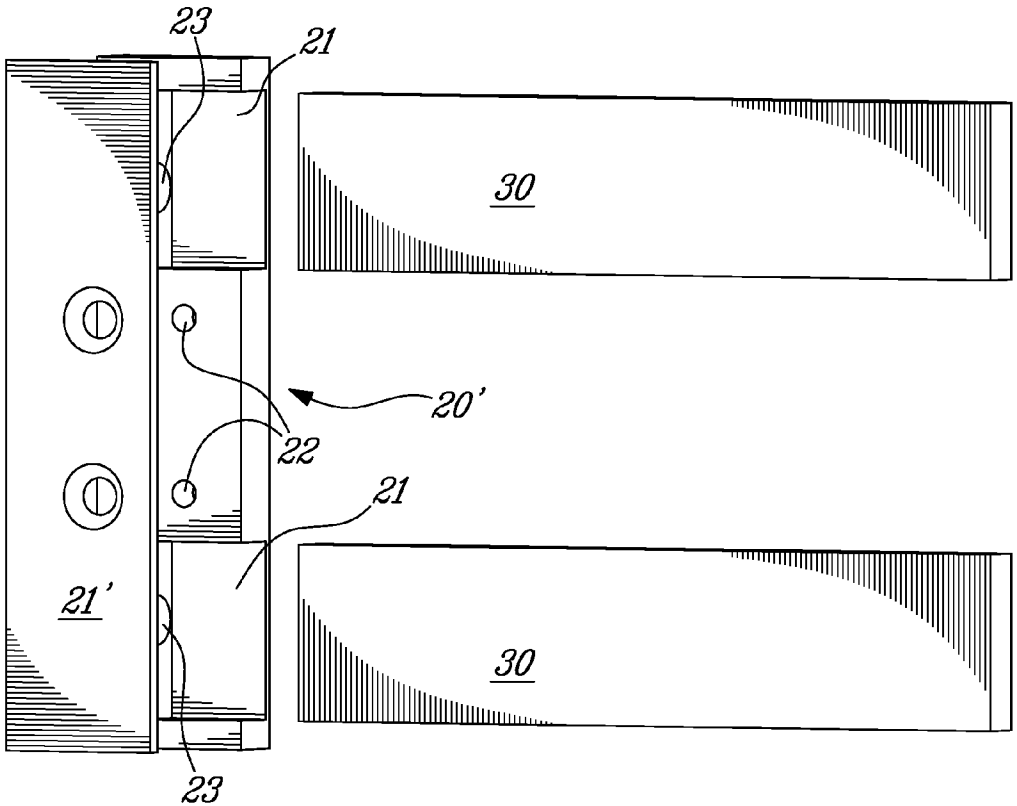
FIG. 8 is a perspective view of a female stopper half of the stopper of FIG. 5.

In another embodiment shown in FIG. 2C, an end member 20' as having a lateral plate 21' being removable (FIG. 8) to access the receptacles 21. In such a case, the ends of the transoms are installed in the receptacles 21, and the lateral plate 21' is then fastened to a remainder of the end member 20' to hold the transoms captive in the receptacles 21. The tapped bores 22 are used to receive fasteners (e.g., bolt, screw, rivet, etc) by which the lateral plate 21' will be connected to the remainder of the end member 20'. As illustrated, the bores 23 may be positioned in the closed end of each of the receptacles 21, or in the same position as for the embodiment of FIGS. 2A and 2B. Moreover, although not shown, a top flange could also be used to screw the end members 20 to a ceiling.

Figure 3B:
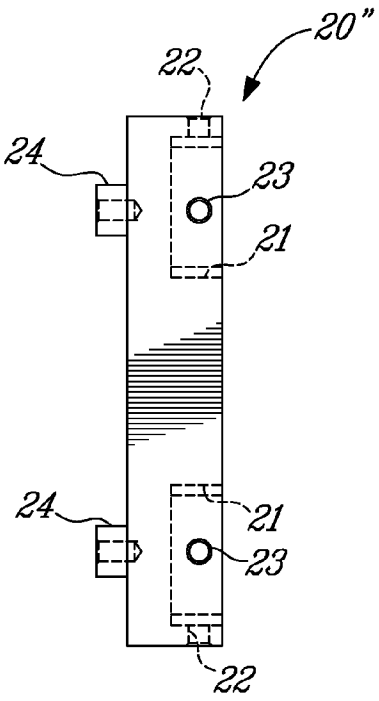
FIG. 3B is a side view of the end member of FIG. 3A.
Figure 3A:
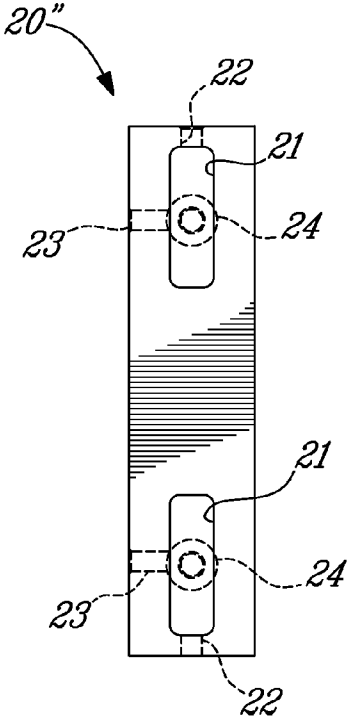
FIG. 3A is a front view of an end member of a door support of the glass sliding door assembly in accordance with another embodiment.

In FIGS. 3A and 3B, end members 20" in accordance with yet another embodiment are illustrated. The end members 20" are similar in configuration to the end members 20 of FIGS. 2A, 2B and 2C, whereby like reference numerals will refer to like elements between the end members 20, 20' and 20". The end member 20" differs from the end members 20 and 20' in that support blocks 24 project from a rear face of the end member 20". The support blocks 24 are integral with the body of the end member 20", and may be tapped to receive a fastener. The support blocks 24 are used to connect the end member 20" to a wall parallel to the rear face of the end member 20". In an embodiment, the wall is a structural glass panel, having throughbores therein to receive the support blocks 24. Although the support blocks 24 are shown having a cylindrical body, any appropriate shape may also be used. A plug or cap is typically secured to the free end of each of the support blocks 24, to hold the support blocks 24 (and thus the end member 20') captive in the throughbores of a support wall.

Figure 3C:
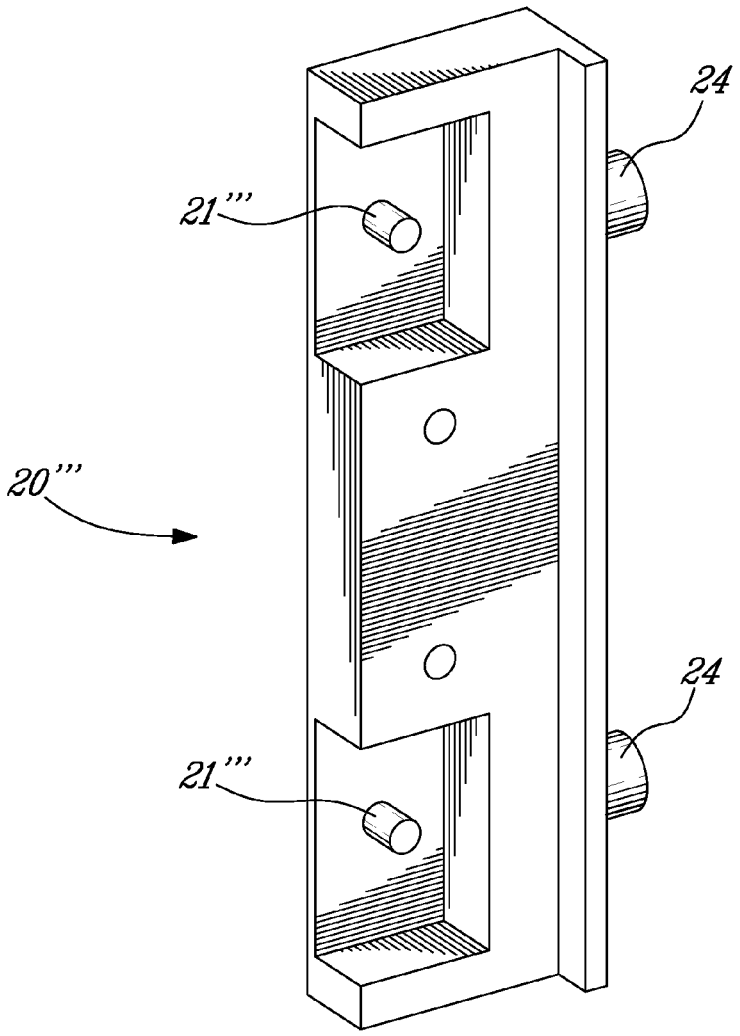
FIG. 3C is a perspective view of an end member of a door support of the glass sliding door assembly of FIG. 1, in accordance with yet another embodiment.
Figure 9:
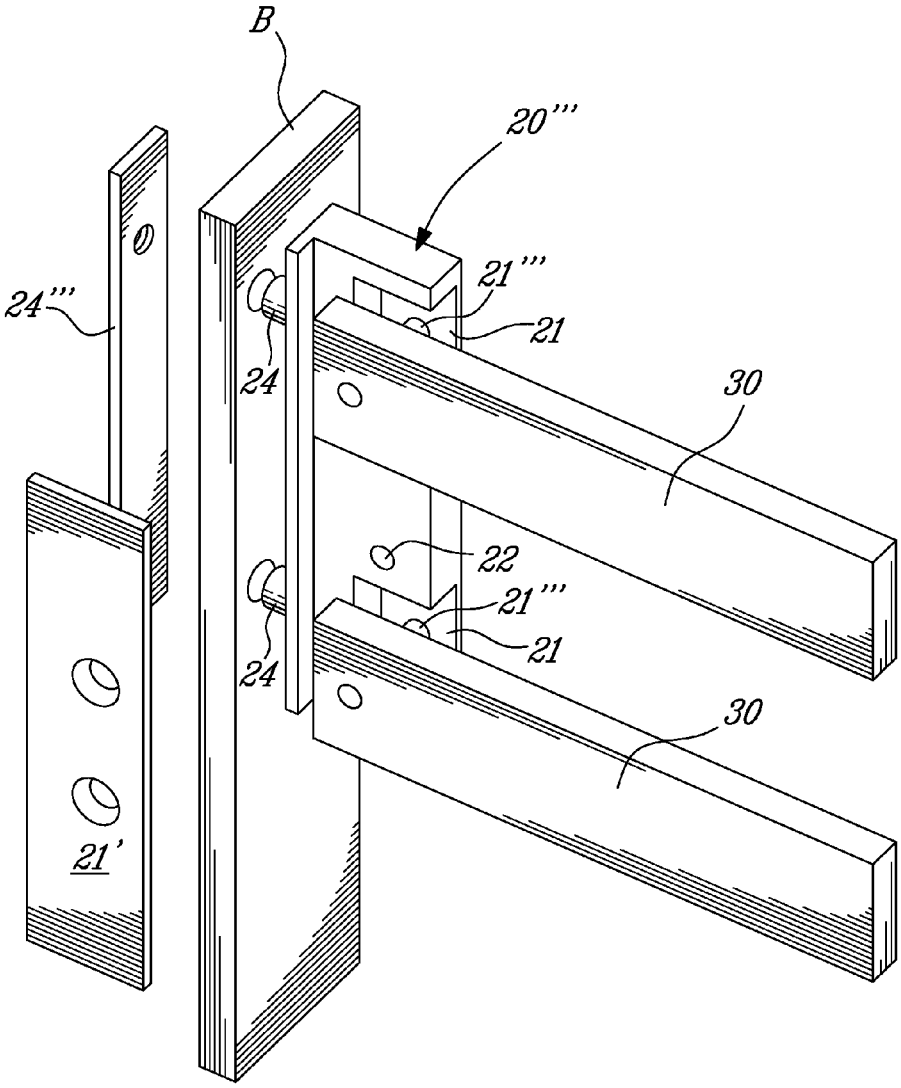
FIG. 9 is an assembly view of the end member of FIG. 3C with a pair of transoms.

In FIG. 3C, end member 20'" is similar to the end member 20" in that is features support blocks 24. The end member 20'" also comprises a lateral plate 21' in similar to the end member 20' of FIG. 2C. As shown in FIG. 9, a connection plate 24'" may be positioned on the opposite side of the structural glass panel, to secure the end member 20'" with any appropriate type of fastener to the structural glass panel. Moreover, pins 21'" may project into a lateral direction within the cavity of the receptacles 21, to be received in a corresponding bore in the transoms, to further enhance the structural integrity between the transom and the end member 20'". The pins 21'" could also be present in the end member 20' of FIG. 2C.

Figure 4A:
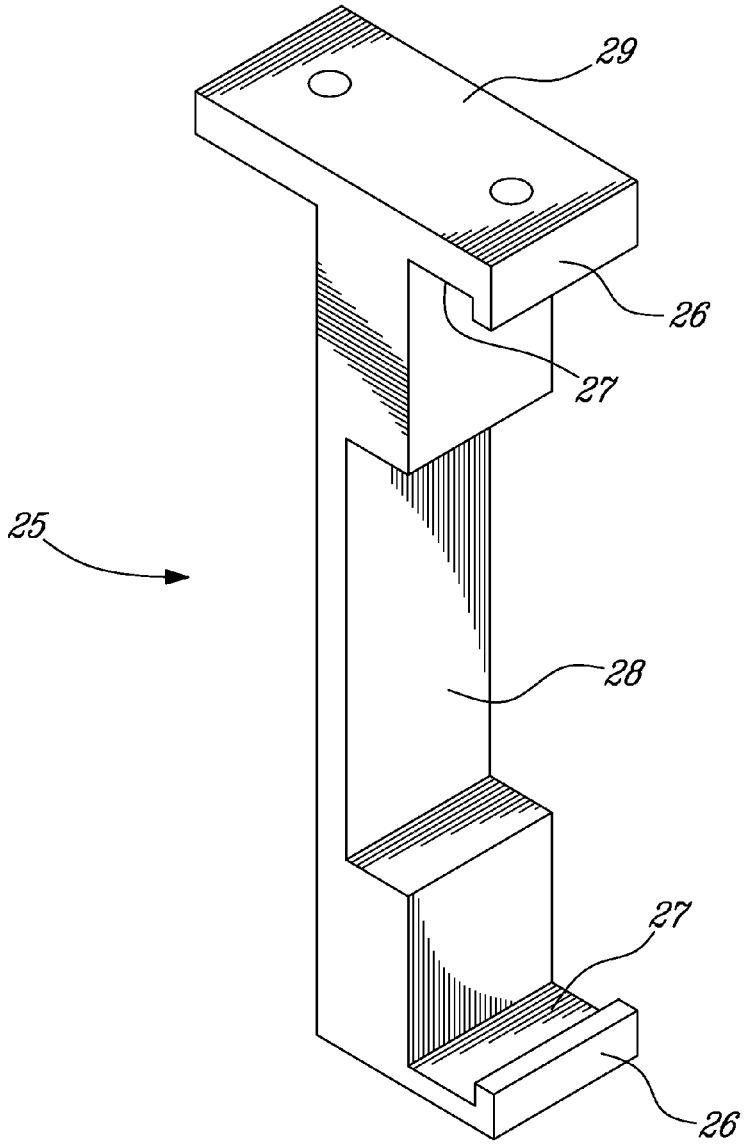
FIG. 4A is a perspective view of an intermediate member of a door support of the glass sliding door assembly of FIG. 1, with flange connection.
Figure 4B:
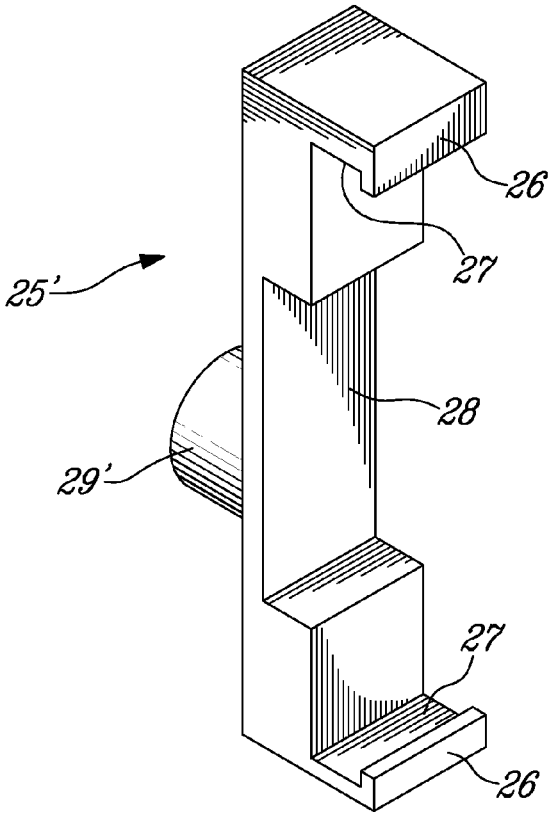
FIG. 4B is a perspective view of an intermediate member of a door support of the glass sliding door assembly of FIG. 1, with support block connection.

Referring to FIGS. 4A and 4B, an intermediate member is illustrated. The expression "intermediate" is used to refer to the positioning of the member 25 between ends of the door support 12 (centered or off-centered). The intermediate member 25 is used when the door support 12 spans a relatively large opening with a pair of sliding doors 11. Similarly to the end members 20, 20', 20" and 20'", the intermediate member 25 has sufficient structural strength to support part of the weight of the glass sliding doors 11, for instance by way of a solid body of a metallic material. Intermediate member 25 has an elongated vertical body with hooks 26 projecting laterally from a bottom and a top of the elongated vertical body. The tips of the hooks 26 are inward, defining grooves 27 for receiving the transoms and generally preventing lateral movements of the transoms. A slot 28 is defined in the elongated vertical body and is generally in register with the spacing between transoms. The slot 28 is sized so as to allow the roller of the roller unit 13 to pass therethrough. Hence, the intermediate member 25 will provide structural support to the transoms, while not blocking the guideway formed between the transoms. A flange 29 is located at a top of the elongated vertical body of the intermediate member 25. The flange 29 may have bores to receive fasteners, and thus allow the intermediate member 25 to be secured to a ceiling or like structure above the intermediate member 25.

Referring to FIG. 4B, an intermediate member 25' is illustrated and is similar in configuration to the intermediate member 25, whereby like elements will bear like reference numerals. The intermediate member 25' differs from the intermediate member 25 in that support block 29' projects from a rear face of the elongated vertical body, as an alternative to the flange 29. The support block 29' is integral with the body of the intermediate member 25', and may be tapped to receive a fastener. The support block 29' is used to connect the intermediate member 25' to a wall parallel to the rear face of the intermediate member 25'. In an embodiment, the wall is a structural glass lintel, having throughbores therein to receive the support block 29'. Although the support block 29' are shown having a cylindrical body, any appropriate shape may also be used. Moreover, plugs, caps, connection plates may be used jointly with the intermediate member 25' in similar fashion to the end member 20'" (FIG. 9).

Figure 4C:
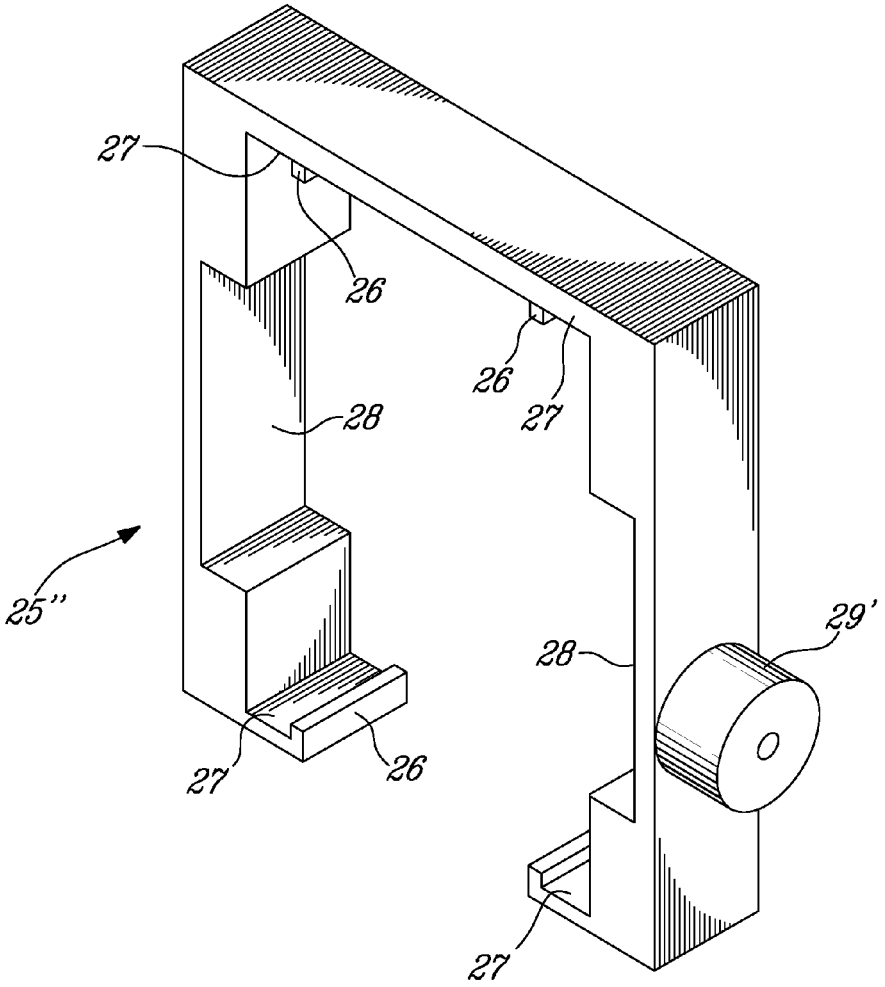
FIG. 4C is a perspective view of a double intermediate member of a door support of the glass sliding door assembly of FIG. 1.

Referring to FIG. 4C, a double intermediate member 25" is illustrated, and essentially consists of the combination of a pair of intermediate members 25/25'. The double intermediate member 25" may therefore support four different transoms. It is observed that the spacing between the elongated vertical bodies in the intermediate member 25" is sufficient to allow a pair of roller units 13 to operate side by side. Although not shown, a flange (e.g., as flange in FIG. 4A) could be used to connect the double intermediate member 25" to a structure.

Referring to FIG. 1, transoms 30 are shown as installed relative to a structure, by way of end members 20/20'/20"/20'" and intermediate member 25/25'/25". The transoms 30 may be referred to as beams, elongated support members, etc, and essentially consist in bars, or rails, upon which the roller units 13 will roll. Intermediate member 25/25'/25" is located somewhere between the ends of the transoms 30, whereas the end members 20/20'/20"/20'" receive the ends of the transoms 30. Accordingly, the intermediate member 25/25'/25" will prevent any substantial downward deflection of the lower transom 30, and substantial lateral deflections of both the lower and upper transom 30 when relatively long spans of transoms 30 are used, for instance in two-door configurations as shown in FIG. 1. The transoms 30 are generally parallel to one another (i.e., parallel or quasi-parallel), whereby a guideway 31 is defined between the transoms 30, and will accommodate the roller portions of the roller units 13. The height of the guideway 31 is selected as a function of the diameter of the roller units 13, to ensure that the roller units 13 are held captive in the guideway 31, by way of the pulley-style flanges of the roller units 13. The transoms 30 must have sufficient strength to support the sliding doors 11, and materials such as metals are preferred. In order to be received in the receptacles 21 of the end members 20/20'/20"/20'" (FIGS. 2A-3C), the transoms 30 have a similar rectangular section. However, other sectional shapes are considered as well for the receptacles 21 and the transoms 30.

Figure 5:
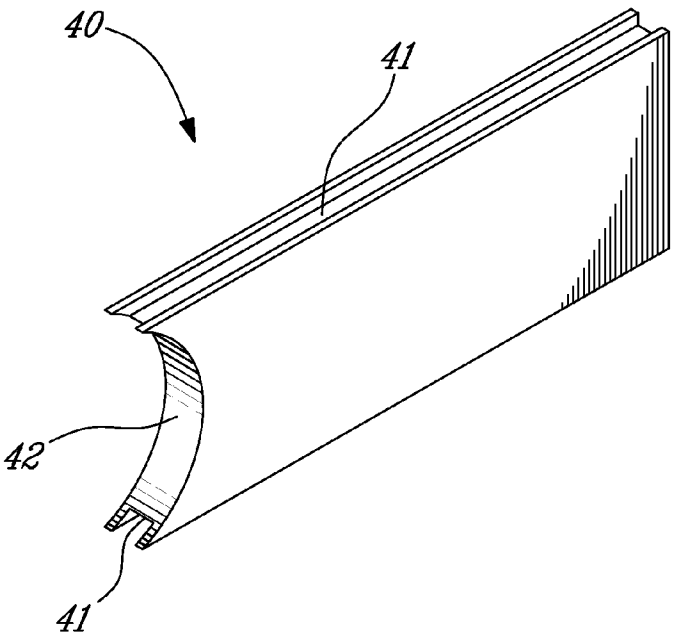
FIG. 5 is a perspective view of a stopper of the glass sliding door assembly of FIG. 1.

Referring to FIG. 5, there is illustrated a stopper 40, to be inserted in the guideway 31 between the transoms 30. in an embodiment, the stopper 40 is adjacent to the end members 20/20'. The stopper 40 has a pair of grooves 41 that will each accommodate an edge of the transoms 30. A circular cutout 42 is designed for the abutment of a roller portion of the roller units 13 therein. Accordingly, the stopper 40 will delimit the end of travel of the glass sliding door 11 in direction A in the guideway 31 (FIG. 1). It is pointed out that the circular cutout 42 may have different shapes than a semi-circle. The stopper 40 is typically made of a metallic material or of a polymeric material that will absorb a portion of the impact resulting from the inertia of the sliding door upon contact of the roller unit 13 with the stopper 40. The stopper 40 is provided in a large dimension so as to allow the customization thereof by cutting same to the appropriate dimensions.

Figure 6:
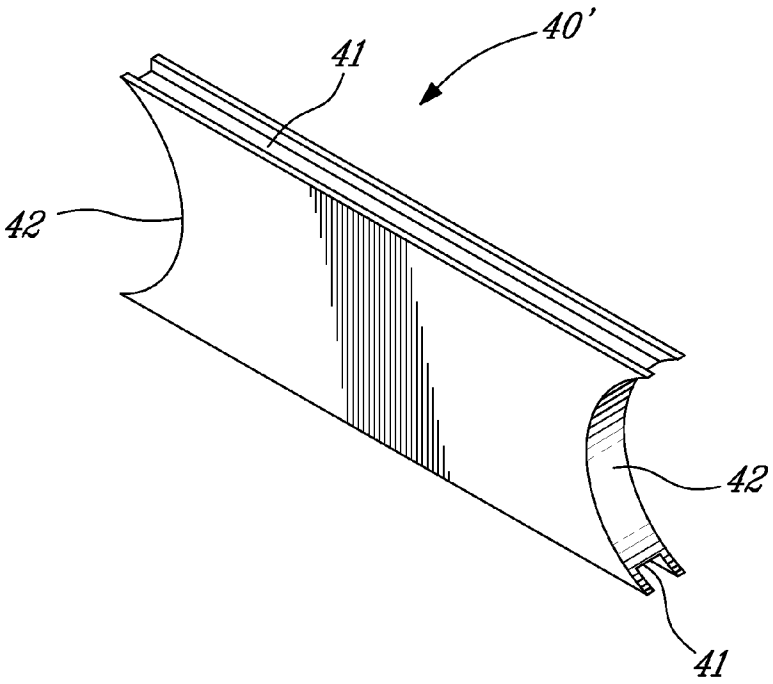
FIG. 6 is a perspective view of a stopper of the door support of the glass sliding door assembly of FIG. 1, in accordance with another embodiment of the present disclosure.

Referring to FIG. 6, a stopper is shown at 40'. Stopper 40' is similar in construction to the stopper 40, whereby like reference numerals will refer to like elements. The stopper 40' be used between a pair of glass sliding doors 11, as it comprises a pair of circular cutouts 42.

Figure 7A:
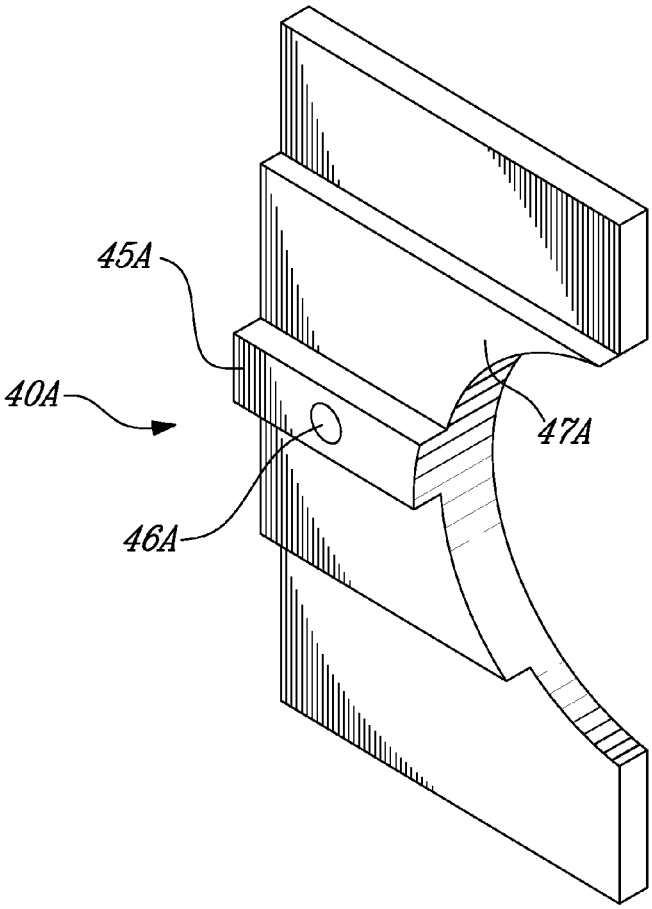
FIG. 7 is a perspective view of a male stopper half of the stopper of FIG. 5.
Figure 7B:
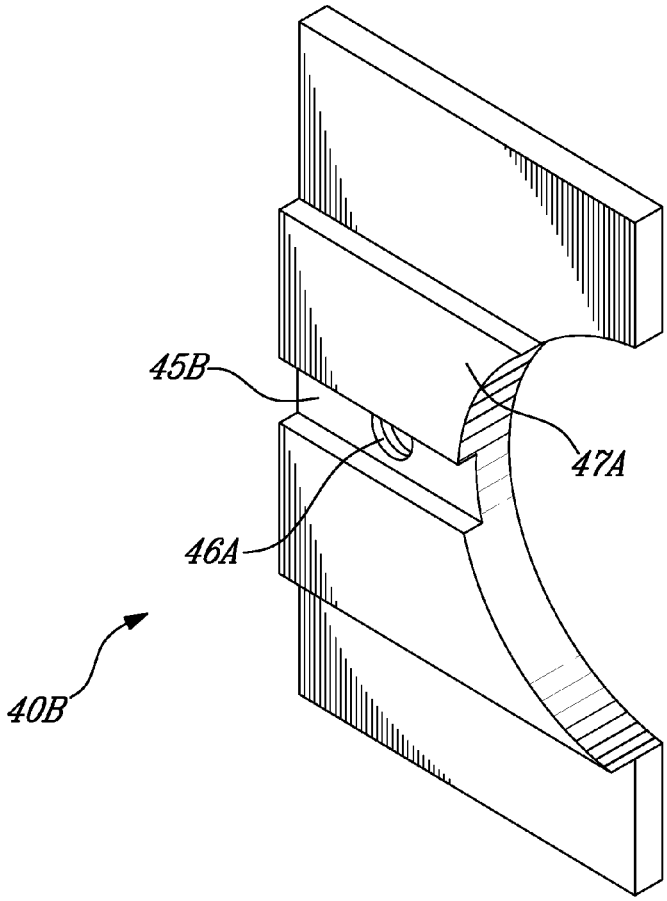

Referring to FIGS. 7A and 7B, a possible construction of the stopper 40, featuring halves 40A and 40B. Mating connectors 45A and 45B, in the form of a slot and rail, mate to interconnect the halves 40A and 40B in the manner shown in FIG. 5. A fastener (e.g., screw, bolt, nut, rivet, etc) is used with the bores 46A and 46B, which bore may be tapped. Raised portions 47A and 47B are sized to generally match the height of the guideway 31, and hence be suitably received between the transoms 30 (FIG. 1). A similar construction could be used with the stopper 40'.

Now that the various components of the assembly 10 have been described, a method of installation is set forth. It is pointed out that the method set forth below represents one of numerous ways to install the door assembly 10. Other sequences are considered as well.

In order to install the various components of the assembly 10 with end members 20' and/or 20'", the end members 20/20'/20"/20'" are secured to the structure at an appropriate location. The transoms 30 may then be cut to a given length, which given length corresponds to the anticipated distance between the end of the receptacles 21, for the end members 20' and 20'". Bores may be made at the ends of the transoms 30 if pins 21'" are present (FIG. 3C).

The transoms 30 are then inserted laterally into the end members 20' and 20'" with the plates 21' then fixed to a remainder of the end members 20' and 20'".

In order to install the various components of the assembly 10 with end members 20 and/or 20", a first one of the end members 20 and/or 20" is firstly secured to the structure at an appropriate location. For the end members 20 and 20", the given length corresponds to the anticipated distance between the front faces of the opposite end members 20/20" plus at most half of the depth of each of the receptacles 21.

Each of the transoms 30 is then inserted in a respective one of the receptacles 21 of the installed end member 20/20". The transom 30 is inserted to the end of the receptacle 21 in which it is received.

At that point, the uninstalled end member 20/20" is fixed to the structure. The transoms 30 may then be slid into the receptacles 21 of the end member 20/20", such that the transom 30 is supported at opposed ends by the end members 20/20". The set screws may then be used in the tapped bores 22 to fix the position of the transoms 30 relative to the end members 20/20". Accordingly, the orientation of the tapped bores 22 must be chosen as a function of the configuration of the structure to which the door assembly will be fixed.

It is pointed out that the pulley portions of the roller units 13 may be inserted in the guideway 31 prior to the end member 20/20" being fixed to the structure. Alternatively, the roller units 13 may be assembled onto the installed transoms 30.

Similarly, the intermediate member 25/25'/25" may be slid into engagement on the transoms 30 prior to the transoms 30 being inserted in the second one of the end members 20/20". Alternatively, the intermediate member 25/25'/25" may be secured to the surrounding structure prior to installation of the transoms 30. Any appropriate installation sequence may be applied, so long as standard safety precautions are taken. Similarly, the stoppers 40/40' and may also be placed in the guideway 31.

Once the transoms 30 are fixed in position in the end members 20/20', with the intermediate member 25 being secured to the structure if applicable, the doors 11 may be hung onto a connector shaft of the roller units 13, among possibilities.

The invention claimed is:

1. A door support kit for a sliding door assembly comprising:

two transoms, each of the two transoms having an elongated body with a first end and a second end, and with transverse bores respectively at the first end and the second end, the elongated body extending in a longitudinal direction; and a pair of end members adapted to be secured to a structure, each of said pair of end members having a first receptacle and a second receptacle, such that a first one of the pair of end members receives the first end of one of the two transoms in the first receptacle and receives the first end of another one of the two transoms in the second receptacle, and such that a second one of the pair of end members receives the second end of the one of the two transoms in the first receptacle and receives the second end of the other one of the two transoms in the second receptacle the first and second receptacles of each said end member being spaced apart and one over the other to hold the two transoms in a spaced apart and generally parallel relation, such that a guideway is defined between the transoms for holding captive a roller portion of at least one roller unit for movement of a glass door in a plane of the glass door, each said end member having a lateral access transverse to the longitudinal direction and a respective pin projecting laterally in each of said first and second receptacles, the pins being received in the respective transverse bores of the transoms by lateral insertion through the lateral access, and each of said pair of end member has a lateral plate releasably secured to a remainder of the end member, the lateral plate closing the lateral access to the receptacles.

2. The door support kit according to claim 1, further comprising at least respective one support block projecting from a body of each said end member, the support block being integral with the end member.

3. The door support kit according to claim 2, wherein the at least one support block has a circular section.

4. The door support kit according to claim 3, further comprising a tapped bore in the at least one support block.

5. The door support kit according to claim 1, further comprising at least one stopper member releasably secured in the guideway between the two transoms.

6. The door support kit according to claim 5, wherein the at least one stopper member has an arcuate abutment surface oriented toward the roller portion.

7. The door support kit according to claim 6, wherein the at least one stopper member has a pair of the arcuate abutment surface at opposite ends.

8. The door support kit according to claim 6, wherein the at least one stopper member consists of stopper member halves matingly interconnected at the guideway.

9. The door support kit according to claim 1, further comprising an intermediate member adapted to be secured to a structure, the intermediate member having an elongated body with at least a first hook portion supporting a lower one of the two transoms to prevent at least one of downward and lateral deflection of the lower transom.

10. The door support kit according to claim 9, wherein the intermediate member comprises a second hook portion connected to an upper one of the two transoms to prevent lateral deflection of the upper transom.

11. The door support kit according to claim 9, wherein a slot is defined in the elongated body, the slot being aligned with the guideway to allow the roller portion to pass through the slot when rolling along the guideway.

12. The door support kit according to claim 1, wherein each of said pair of end member has a solid body with the first and second receptacles of the respective end member being formed into the solid body, and with the lateral pins being part of the solid body, with a portion of the solid body spacing the first and second receptacles from one another, the lateral plate releasably secured to the solid body.

13. A sliding door assembly comprising:

at least one glass door;

at least one roller unit secured to a top portion of each the at least one glass door, the roller unit having a roller portion projecting out of a plane of the glass door;

the door support kit according to claim 1.

14. The sliding door assembly according to claim 13, further comprising at least one stopper member releasably secured in the guideway between the two transoms.

15. The sliding door assembly according to claim 13, further comprising an intermediate member adapted to be secured to a structure, the intermediate member having an elongated body with at least a first hook portion supporting a lower one of the two transoms to prevent at least one of downward and lateral deflection of the lower transom.

16. The sliding door assembly according to claim 15, wherein a slot is defined in the elongated body, the slot being aligned with the guideway to allow the roller portion to pass through the slot when rolling along the guideway.

17. The sliding door assembly according to claim 13, wherein the door is an all-glass door.

* * * * *